US009301599B1

(12) United States Patent
Ritchie

(10) Patent No.: US 9,301,599 B1
(45) Date of Patent: Apr. 5, 2016

(54) INCLINABLE DESK DEVICE

(71) Applicant: Rick Ritchie, American Canyon, CA (US)

(72) Inventor: Rick Ritchie, American Canyon, CA (US)

( * ) Notice: Subject to any disclaimer, the term of this patent is extended or adjusted under 35 U.S.C. 154(b) by 0 days.

(21) Appl. No.: 14/592,953

(22) Filed: Jan. 9, 2015

(51) Int. Cl.

| | |
|---|---|
| ***A47B 37/00*** | (2006.01) |
| ***A47B 21/03*** | (2006.01) |
| ***A47B 13/08*** | (2006.01) |
| ***A47B 13/00*** | (2006.01) |
| *A47B 41/02* | (2006.01) |

(52) U.S. Cl.
CPC ..... *A47B 21/03* (2013.01); *A47B 13/003* (2013.01); *A47B 13/081* (2013.01); *A47B 37/00* (2013.01); *A47B 41/02* (2013.01)

(58) Field of Classification Search
CPC ..... A47B 37/00; A47B 41/02; A47B 37/02
USPC ..... 108/1, 5, 6, 42
See application file for complete search history.

(56) References Cited

U.S. PATENT DOCUMENTS

| | | | | | |
|---|---|---|---|---|---|
| 841,766 | A * | 1/1907 | Campbell | A47B 9/16 | 108/6 |
| 1,188,792 | A * | 6/1916 | Kormendy | A47B 23/02 | 108/5 |
| 1,420,404 | A * | 6/1922 | Beaver | A47B 41/02 | 108/8 |
| 1,907,780 | A * | 5/1933 | Froelich | A47B 27/02 | 108/6 |
| 2,244,391 | A * | 6/1941 | De Lisle | A47B 27/00 | 108/9 |
| 2,452,216 | A * | 10/1948 | Yarber | A47B 27/18 | 108/6 |
| 3,848,543 | A * | 11/1974 | Johnston | A47F 5/12 | 108/5 |
| 4,441,432 | A * | 4/1984 | Carlton | A47B 37/02 | 108/139 |
| 4,625,657 | A * | 12/1986 | Little | A47B 21/0314 | 108/138 |
| 4,717,112 | A * | 1/1988 | Pirkle | A47B 21/02 | 108/140 |
| D313,629 | S | 1/1991 | Hoffman | | |
| 5,172,641 | A * | 12/1992 | Auer | A47B 13/081 | 108/5 |
| 5,566,609 | A | 10/1996 | Kirschner | | |
| 5,577,806 | A * | 11/1996 | Ugalde | A47C 16/025 | 108/5 |
| 6,805,237 | B2 | 10/2004 | Curry | | |
| 7,219,822 | B2 | 5/2007 | Chretien et al. | | |
| 7,546,996 | B2 | 6/2009 | Somji | | |
| 2011/0219988 | A1 * | 9/2011 | Stephens | A47B 9/00 | 108/6 |

* cited by examiner

*Primary Examiner* — Daniel Rohrhoff

(57) ABSTRACT

An inclinable desk device includes a panel that may be used to support an object. Each of a pair of mounts is configured for being coupled to a support surface. The panel is slidably adjustable relative to the mounts to achieve a desired angle with respect to the support surface.

5 Claims, 4 Drawing Sheets

INCLINABLE DESK DEVICE

BACKGROUND OF THE DISCLOSURE

Field of the Disclosure

The disclosure relates to desk devices and more particularly pertains to a new desk device for providing an inclined work surface on an otherwise horizontal work surface.

SUMMARY OF THE DISCLOSURE

An embodiment of the disclosure meets the needs presented above by generally comprising a panel that may be used to support an object. Each of a pair of mounts is configured for being coupled to a support surface. The panel is slidably adjustable relative to the mounts to achieve a desired angle with respect to the support surface.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
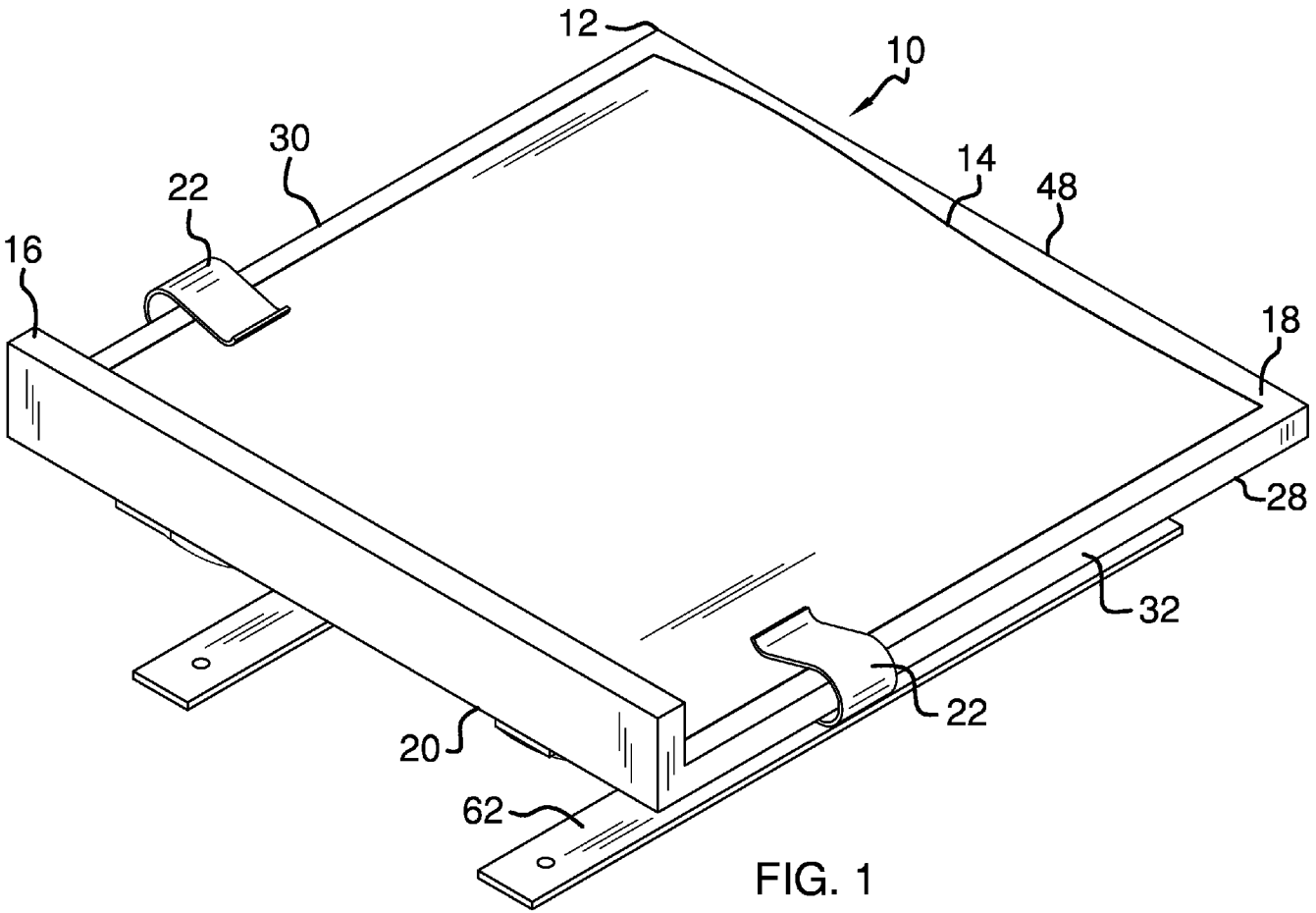
FIG. 1 is a perspective view of an inclinable desk device according to an embodiment of the disclosure.
Figure 2:
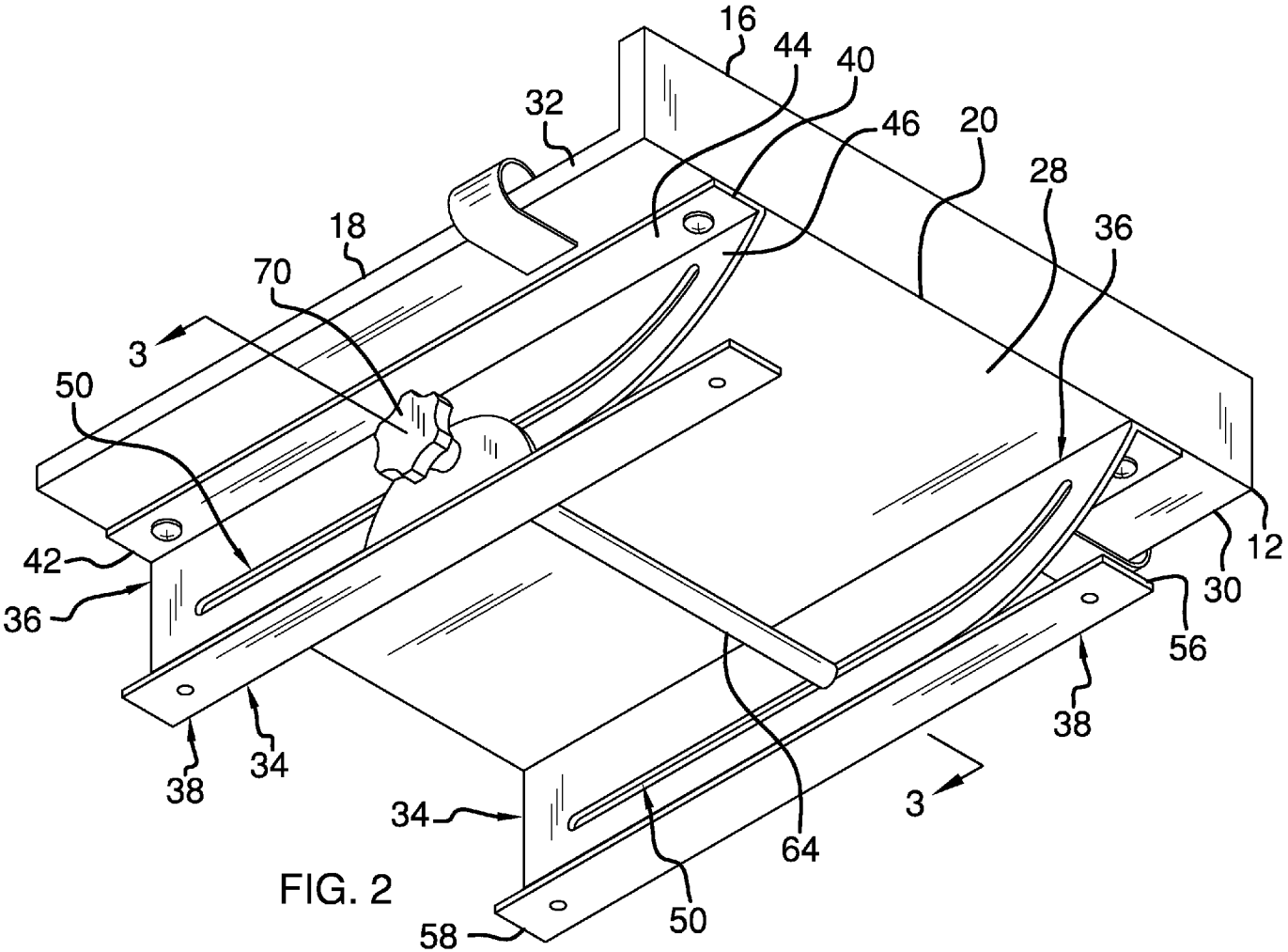
FIG. 2 is a bottom perspective view of an embodiment of the disclosure.
Figure 3:
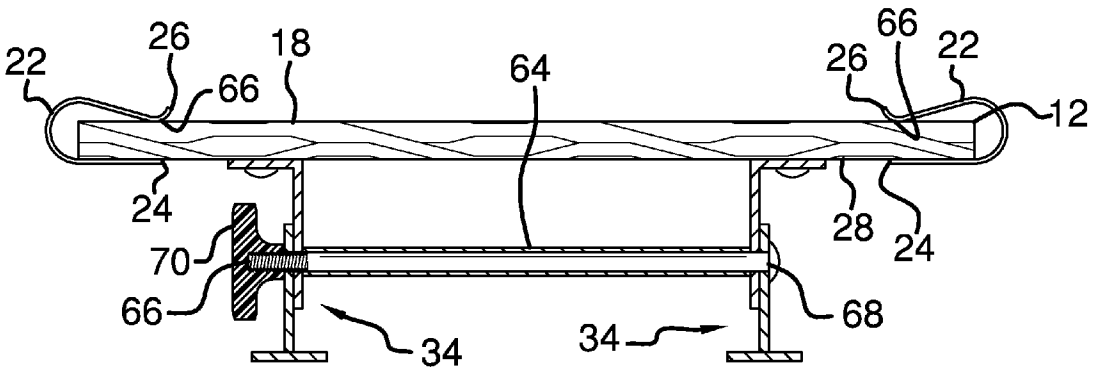
FIG. 3 is a cross sectional view taken along line 3-3 of FIG. 2 of an embodiment of the disclosure.
Figure 4:
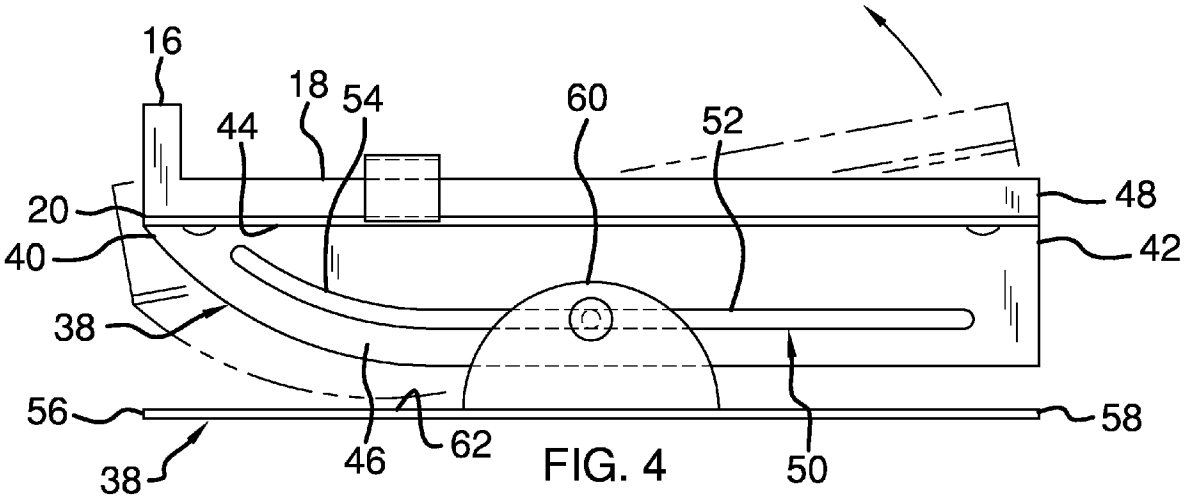
FIG. 4 is a left side view of an embodiment of the disclosure.
Figure 5:
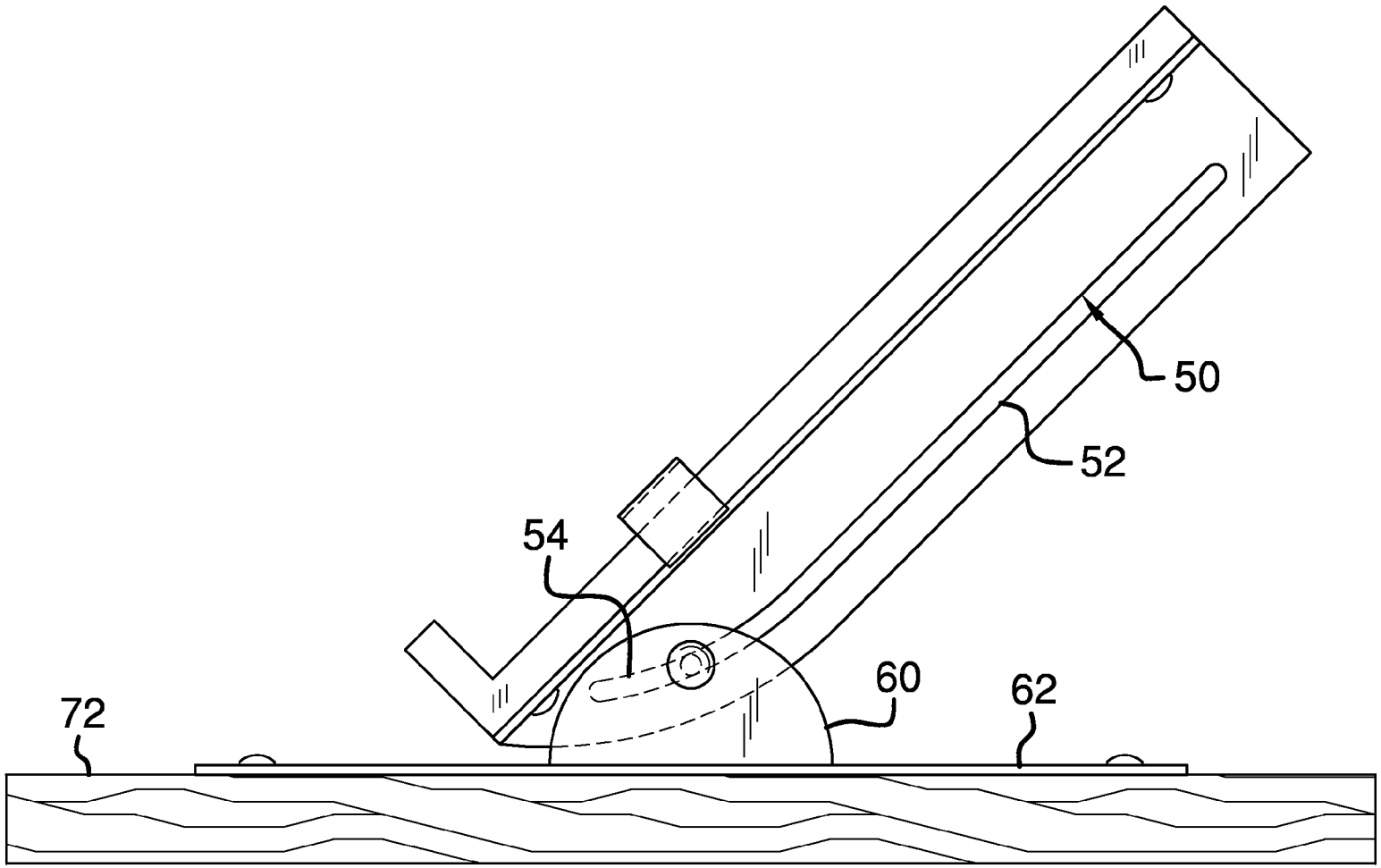
FIG. 5 is an in-use view of an embodiment of the disclosure.

With reference now to the drawings, and in particular to FIGS. 1 through 5 thereof, a new desk device embodying the principles and concepts of an embodiment of the disclosure and generally designated by the reference numeral 10 will be described.

As best illustrated in FIGS. 1 through 5, the inclinable desk device 10 generally comprises a panel 12. The panel 12 may support an object 14. The object 14 may be a document or the like. A lip 16 is coupled to and extends upwardly from a top side 18 of the panel 12. The lip 16 is coextensive with a forward edge 20 of the panel 12. The lip 16 inhibits the object 14 on the panel 12 from sliding off of the panel 12 over the forward edge 20.

Each of a pair of clips 22 has a coupled end 24 and a free end 26. Each coupled end 24 is coupled to the panel 12. Each of the clips 22 is curved between the coupled end 24 and the free end 26 such that a medial portion 66 between the coupled end 24 and the free end 26 resiliently abuts the panel 12 such that each clip 22 is configured for frictionally engaging and facilitating retention of the object 14 on the panel 12. The coupled end 24 of each of the clips 22 is coupled to a bottom side 28 of the panel 12 such that each of the free ends 26 is directed inwardly from a perimeter edge of the panel 12 and over the top side 18 of the panel 12. Each of the clips 22 is positioned adjacent to an associated one of a first lateral edge 30 and a second lateral edge 32 of the panel 12. Each clip 22 is further curved such that the free end 26 of each of the clips 22 is positioned in spaced relationship to the top side 18 of the panel 12 facilitating insertion of the object 14 between the medial portion 66 of the clip 22 and the top side 18 of the panel 12.

Each of a pair of mounts 34 comprises a respective upper section 36 and a respective lower section 38. Each of the upper sections 36 has a respective front end 40 and a respective back end 42. Additionally, each of the upper sections 36 is bent along a lengthwise axis to define a horizontal portion 44 of the upper sections 36 forming a right angle with respect to a vertical portion 46 of the upper sections 36.

Each of the horizontal portions 44 is coupled to the bottom side 28 of the panel 12 such that each of the vertical portions 46 extends downwardly from the bottom side 28. Each of the front ends 40 and the back ends 42 are positioned adjacent to an associated one of the forward edge 20 and a rearward edge 48 of the panel 12. Each of the mounts 34 is positioned proximate an associated one of the first lateral edge 30 and the second lateral edge 32 of the panel 12. Each of the vertical portions 46 of the mounts 34 has a slot 50 extending therethrough. The slots 50 extend between the front ends 40 and the back ends 42. Each of the slots 50 curves upwardly proximate the front ends 40 to define a flat portion 52 and a lifting portion 54 of the slots 50.

Each of the lower sections 38 has a respective frontmost end 56 and a respective rearmost end 58. Each of the lower sections 38 has a respective lobe 60 extending upwardly from a respective topmost side 62 of each of the lower sections 38. Moreover, each of the lobes 60 is centrally positioned on the associated lower sections 38.

A rod 64 has a first end 66 and a second end 68. The rod 64 extends between the mounts 34 and through the slot 50 in each of the vertical portions 46 such that the rod 64 is slidable within the slots 50 along an entire length of each of the slots 50. Each of the first end 66 and the second end 68 engages an associated one of the lobes 60, coupling each of the lower sections 38 to the rod 64. Each of a pair of knobs 70 is coupled to an associated one of the first end 66 and the second end 68. Each of the knobs 70 may be tightened on the rod 64 to engage the associated lobe 60, retaining the rod 64 at a desired point along the slots 50.

Each of the lower sections 38 is couplable to a support surface 72 such that the panel 12 is spaced upwardly from the support surface 72. The support surface 72 may be a table or the like. The top side 18 of the panel 12 lies on a plane that is parallel to the topmost side 62 of the lower sections 38 when the rod 64 is positioned within the flat portion 52 of the slots 50. The top side 18 of the panel 12 is oriented at a selected angle with respect to the topmost side 62 when the rod 64 is secured to the mounts within the lifting portion 54 of the slots 50. The panel 12 allows the object 14 to be inclined with respect to an observer.

In use, the device 10 is utilized to provide an inclined work surface on an otherwise horizontal work surface. The panel 12 is adjusted on the rod 64 until the panel 12 is oriented at a selected angle with respect the observer. Each of the knobs 70 is tightened to retain the panel 12 at the selected angle.

With respect to the above description then, it is to be realized that the optimum dimensional relationships for the parts of an embodiment enabled by the disclosure, to include variations in size, materials, shape, form, function and manner of operation, device and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. An inclinable desk device comprising:

a panel configured to support an object;

a pair of mounts, each of said mounts being configured to be coupled to a support surface, said panel being slidably coupled to said mounts; and a pair of slots, each of said slots extending through an associated one of said mounts, each of said slots being curved to define a flat portion and a lifting portion of said slots, said panel being slidably coupled to said slots wherein an angle of said panel relative to said mounts is adjustable as said panel is moved in said slots;

each of said mounts comprising a respective upper section and a respective lower section, each of said upper sections having a respective front end and a respective back end, each of said upper sections being bent along a lengthwise axis to define a horizontal portion of said upper sections forming a right angle with respect to a vertical portion of said upper sections;

each of said lower sections having a respective frontmost end and a respective rearmost end, each of said lower sections having a respective lobe extending upwardly from a respective topmost side of each of said lower sections, each of said lobes being centrally positioned on said associated lower sections; and a rod, said rod having a first end and a second end, said rod extending between said mounts and through said slot in each of said vertical portions such that said rod is slidable along an entire length of each of said slots, each of said first end and said second end engaging an associated one of said lobes such that each of said lower sections is coupled to said rod.

2. The device according to claim 1, wherein said horizontal portions being coupled to a bottom side of said panel such that said vertical portions extends downwardly from said bottom side, each of said front ends and said back ends being positioned adjacent to an associated one of a forward edge and a rearward edge of said panel, each of said mounts being positioned proximate an associated one of a first lateral edge and a second lateral edge of said panel.

3. The device according to claim 2, further comprising each said slot extending through said vertical portion of said associated mount, said slots extending between said front ends and said back ends of said upper section of said associated mount, said slots curving upwardly proximate said front ends of said upper sections.

4. The device according to claim 1, further comprising each of said lower sections being coupled to a support surface such that said panel is spaced upwardly from the support surface, a top side of said panel lying on a plane being parallel to said topmost side of said lower sections when said rod is positioned within a flat portion of said slots, said top side of said panel being oriented at a selected angle with respect to said topmost side when said rod is positioned in a lifting portion of said slots.

5. An inclinable desk device comprising:

a panel configured to support an object;

a pair of mounts, each of said mounts being configured to be coupled to a support surface, said panel being slidably coupled to said mounts, each of said mounts comprising a respective upper section and a respective lower section, each of said upper sections having a respective front end and a respective back end, each of said upper sections being bent along a lengthwise axis to define a horizontal portion of said upper sections forming a right angle with respect to a vertical portion of said upper sections, said horizontal portions being coupled to a bottom side of said panel such that said vertical portions extends downwardly from said bottom side, each of said front ends and said back ends being positioned adjacent to an associated one of a forward edge and a rearward edge of said panel, each of said mounts being positioned proximate an associated one of a first lateral edge and a second lateral edge of said panel, each of said lower sections having a respective frontmost end and a respective rearmost end, each of said lower sections having a respective lobe extending upwardly from a respective topmost side of each of said lower sections, each of said lobes being centrally positioned on said associated lower sections;

a pair of slots, each of said slots extending through an associated one of said mounts, each of said slots being curved to define a flat portion and a lifting portion of said slots, said panel being slidably coupled to said slots wherein an angle of said panel relative to said mounts is adjustable as said panel is moved in said slots, each said slot extending through said vertical portion of said associated mount, said slots extending between said front ends and said back ends of said upper section of said associated mount, said slots curving upwardly proximate said front ends of said upper sections;

a rod, said rod having a first end and a second end, said rod extending between said mounts and through said slot in each of said vertical portions such that said rod is slidable along an entire length of each of said slots, each of said first end and said second end engaging an associated one of said lobes such that each of said lower sections is coupled to said rod; and wherein each of said lower sections is configured for coupling to the support surface such that said panel is spaced upwardly from the support surface, said top side of said panel lying on a plane being parallel to said topmost side of said lower sections when said rod is positioned within a flat portion of said slots, said top side of said panel being oriented at a selected angle with respect to said topmost side when said rod is positioned in a lifting portion of said slots.

* * * * *